US011732531B2

(12) United States Patent
Zahradnik et al.

(10) Patent No.: US 11,732,531 B2
(45) Date of Patent: Aug. 22, 2023

(54) MODULAR EARTH BORING TOOLS HAVING FIXED BLADES AND REMOVABLE BLADE ASSEMBLIES AND RELATED METHODS

(71) Applicant: Baker Hughes Oilfield Operations LLC, Houston, TX (US)

(72) Inventors: Anton F. Zahradnik, Sugar Land, TX (US); Rudolf Carl Pessier, Houston, TX (US); Don Q. Nguyen, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/339,657

(22) Filed: Jun. 4, 2021

(65) Prior Publication Data

US 2022/0389766 A1 Dec. 8, 2022

(51) Int. Cl.
*E21B 10/43* (2006.01)
*E21B 10/633* (2006.01)

(52) U.S. Cl.
CPC ..... *E21B 10/43* (2013.01); *E21B 10/633* (2013.01)

(58) Field of Classification Search
CPC ..... E21B 10/42; E21B 10/633
See application file for complete search history.

(56) References Cited

U.S. PATENT DOCUMENTS

| | | | | |
|---|---|---|---|---|
| 4,610,452 | A * | 9/1986 | DiRienz | F16J 15/3456 175/371 |
| 5,323,865 | A | 6/1994 | Isbell et al. | |
| 5,746,280 | A | 5/1998 | Scott et al. | |
| 5,855,247 | A | 1/1999 | Scott et al. | |
| 6,098,730 | A | 8/2000 | Scott et al. | |
| 6,298,930 | B1 | 10/2001 | Sinor et al. | |
| 6,332,503 | B1 | 12/2001 | Pessier et al. | |
| 6,460,631 | B2 | 10/2002 | Dykstra et al. | |
| 6,779,613 | B2 | 8/2004 | Dykstra et al. | |
| 6,935,441 | B2 | 8/2005 | Dykstra et al. | |
| 8,061,456 | B2 | 11/2011 | Patel et al. | |
| 8,240,403 | B2 | 8/2012 | Trinh et al. | |
| 8,361,859 | B2 | 1/2013 | Adam et al. | |
| 8,978,786 | B2 | 3/2015 | Nguyen et al. | |
| 9,074,435 | B2 | 7/2015 | Scott et al. | |
| 9,316,058 | B2 | 4/2016 | Bilen et al. | |

(Continued)

*Primary Examiner* — Giovanna Wright
*Assistant Examiner* — Ronald R Runyan
(74) *Attorney, Agent, or Firm* — TraskBritt

(57) ABSTRACT

An earth-boring tool includes a body, a plurality of fixed blades, a first plurality of cutting elements secured to the plurality of fixed blades, a plurality of removable blade assemblies removably coupled to the body, and a second plurality of cutting elements secured to the plurality of removable blade assemblies, each cutting element of the second plurality of cutting elements exhibiting an aggressiveness that is less than an aggressiveness of each cutting element of the first plurality of cutting elements. A method of forming an earth-boring tool includes forming a body and a plurality of fixed blades extending from the body, securing a first plurality of cutting elements to the plurality of fixed blades, removably coupling at least one removable blade assembly to the body, and securing a second plurality of cutting elements to the at least one removable blade assembly.

20 Claims, 7 Drawing Sheets

(56) References Cited

U.S. PATENT DOCUMENTS

| | | | | |
|---|---|---|---|---|
| 10,107,039 | B2 | 10/2018 | Schroder | |
| 10,697,248 | B2 | 6/2020 | Russell et al. | |
| 10,907,414 | B2 | 2/2021 | Schoen | |
| 10,954,721 | B2 | 3/2021 | Russell et al. | |
| 2009/0008154 | A1* | 1/2009 | El Hakam | C22C 38/04 175/425 |
| 2009/0159341 | A1 | 6/2009 | Pessier et al. | |
| 2009/0272582 | A1* | 11/2009 | McCormick | E21B 10/24 175/336 |
| 2012/0111638 | A1 | 5/2012 | Nguyen et al. | |
| 2012/0205160 | A1 | 8/2012 | Ricks et al. | |
| 2015/0107909 | A1 | 4/2015 | Zahradnik | |
| 2020/0123858 | A1* | 4/2020 | Zhang | E21B 10/54 |

* cited by examiner

MODULAR EARTH BORING TOOLS HAVING FIXED BLADES AND REMOVABLE BLADE ASSEMBLIES AND RELATED METHODS

TECHNICAL FIELD

This disclosure relates generally to earth-boring tools having removable blade assemblies. This disclosure also relates to modular earth-boring tools having fixed blades and removable blade assemblies.

BACKGROUND

Oil and gas wells (wellbores) are usually drilled with a drill string. The drill string includes a tubular member having a drilling assembly that includes a single drill bit at its bottom end. The drilling assembly may also include devices and sensors that provide information relating to a variety of parameters relating to the drilling operations ("drilling parameters"), behavior of the drilling assembly ("drilling assembly parameters") and parameters relating to the formations penetrated by the wellbore ("formation parameters"). A drill bit and/or reamer attached to the bottom end of the drilling assembly is rotated by rotating the drill string from the drilling rig with a rotary table or top drive and/or by a drilling motor (also referred to as a "mud motor") in the bottom hole assembly ("BHA") under applied weight on bit (WOB) to remove formation material to drill the wellbore.

BRIEF SUMMARY

Some embodiments of the present disclosure include earth-boring tools. The earth-boring tools may include a body, a plurality of fixed blades extending from the body, a first plurality of cutting elements secured to the plurality of fixed blades, a plurality of removable blade assemblies removably coupled to the body, and a second plurality of cutting elements secured to the plurality of removable blade assemblies, each cutting element of the second plurality of cutting elements exhibiting an aggressiveness that is less than an aggressiveness of each cutting element of the first plurality of cutting elements.

Additional embodiments include removable blade assemblies. The removable blade assemblies may a leg configured to be received within a receiving slot of the body of an earth-boring tool, a blade portion extending from the leg, and a plurality of cutting elements secured to the blade portion, the a plurality of cutting elements exhibiting an aggressiveness that is less than an aggressiveness of other cutting elements of the earth-boring tool.

Some embodiments of the present disclosure include a method of forming an earth-boring tool. The method may include forming a body and a plurality of fixed blades extending from the body, securing a first plurality of cutting elements to the plurality of fixed blades, removably coupling at least one removable blade assembly to the body, and securing a second plurality of cutting elements to the at least one removable blade assembly, each cutting element of the second plurality of cutting elements exhibiting an aggressiveness that is less than an aggressiveness of each cutting element of the first plurality of cutting elements.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
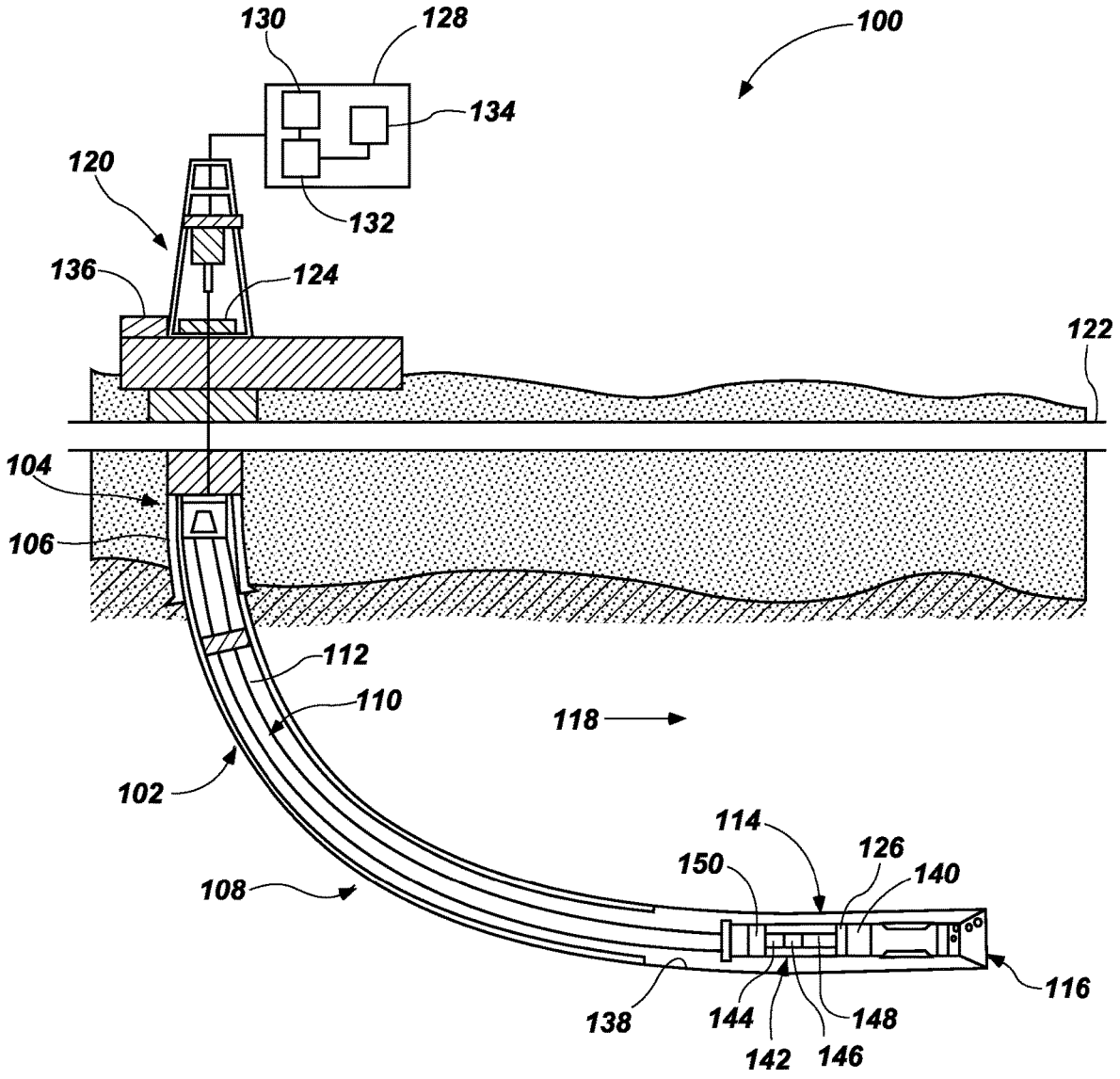
FIG. 1 is a schematic diagram of a wellbore system comprising a drill string that includes an earth-boring tool according to one or more embodiments of the present disclosure.

The illustrations presented herein are not actual views of any drill bit, roller cutter, or any component thereof, but are merely idealized representations, which are employed to describe the present invention.

As used herein, the terms "bit" and "earth-boring tool" each mean and include earth-boring tools for forming, enlarging, or forming and enlarging a borehole. Non-limiting examples of bits include fixed-cutter (drag) bits, fixed-cutter coring bits, fixed-cutter eccentric bits, fixed-cutter bi-center bits, fixed-cutter reamers, expandable reamers with blades bearing fixed-cutters, and hybrid bits including both fixed-cutters and rotatable cutting structures (roller cones).

As used herein, the term "cutting elements" means and includes, for example, superabrasive (e.g., polycrystalline diamond compact or "PDC") cutting elements employed as fixed cutting elements, as well as tungsten carbide inserts and superabrasive inserts employed as cutting elements mounted to rotatable cutting structures, such as roller cones.

As used herein, any relational term, such as "first," "second," "top," "bottom," etc., is used for clarity and convenience in understanding the disclosure and accompanying drawings, and does not connote or depend on any specific preference or order, except where the context clearly indicates otherwise. For example, these terms may refer to an orientation of elements of an earth-boring tool when disposed within a borehole in a conventional manner. Furthermore, these terms may refer to an orientation of elements of an earth-boring tool when as illustrated in the drawings.

As used herein, the terms "comprising," "including," "containing," "characterized by," and grammatical equivalents thereof are inclusive or open-ended terms that do not exclude additional, un-recited elements or method steps, but also include the more restrictive terms "consisting of," "consisting essentially of," and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, the term "about" used in reference to a given parameter is inclusive of the stated value and has the meaning dictated by the context (e.g., it includes the degree of error associated with measurement of the given parameter).

Embodiments of the present disclosure include a modular earth-boring tool (e.g., a modular drill bit) with a modifiable aggressiveness. In particular, the modular earth-boring tool may include a body having one or more fixed blade and one or more receiving slots sized and shaped to receive removable blade and/or roller cone assemblies, and the aggressiveness of the modular earth-boring tool may be selected and/or modified depending on removable blade and/or roller cone assemblies attached to the modular earth-boring tool. As a result, an aggressiveness of the earth-boring tool may be easily modified by exchanging one or more of the removable blade and/or roller cone assemblies of the modular earth-boring tool. Furthermore, in some embodiments, the removable blade assemblies may be configured to deform (e.g., at least partially deflect) during operation and may provide a variable depth of cut depending on weight on bit applied to the modular earth-boring tool.

As noted above, the term "aggressiveness" may refer to a relationship between a rate of penetration (ROP) of an earth-boring tool and range of weight-on-bit (WOB). In particular, the term "aggressiveness" may be defined as a slope of a ROP of an earth-boring tool versus WOB curve. Additionally, the aggressiveness of an earth-boring tool may refer to a depth of cut for a given WOB.

FIG. 1 is a schematic diagram of an example of a drilling system 100 that may utilize the apparatuses and methods disclosed herein for drilling boreholes. FIG. 1 shows a borehole 102 that includes an upper section 104 with a casing 106 installed therein and a lower section 108 that is being drilled with a drill string 110. The drill string 110 may include a tubular member 112 that carries a drilling assembly 114 at its bottom end. The tubular member 112 may be made up by joining drill pipe sections or it may be a string of coiled tubing. A drill bit 116 may be attached to the bottom end of the drilling assembly 114 for drilling the borehole 102 of a selected diameter in a formation 118.

The drill string 110 may extend to a rig 120 at surface 122. The rig 120 shown is a land rig 120 for ease of explanation. However, the apparatuses and methods disclosed equally apply when an offshore rig 120 is used for drilling boreholes under water. A rotary table 124 or a top drive may be coupled to the drill string 110 and may be utilized to rotate the drill string 110 and to rotate the drilling assembly 114, and thus the drill bit 116 to drill the borehole 102. A drilling motor 126 may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the borehole 102 is drilled. A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of the various devices and sensors 140 in the drilling assembly 114. The sensors 140 may include one or more of sensors 140 that determine acceleration, weight on bit, torque, pressure, cutting element positions, rate of penetration, inclination, azimuth formation/lithology, etc. In some embodiments, the surface control unit 128 may include a processor 130 and a data storage device 132 (or a computer-readable medium) for storing data, algorithms, and computer programs 134. The data storage device 132 may be any suitable device, including, but not limited to, a read-only memory (ROM), a random-access memory (RAM), a Flash memory, a magnetic tape, a hard disk, and an optical disc. During drilling, a drilling fluid from a source 136 thereof may be pumped under pressure through the tubular member 112, which discharges at the bottom of the drill bit 116 and returns to the surface 122 via an annular space (also referred as the "annulus") between the drill string 110 and an inside sidewall 138 of the borehole 102.

The drilling assembly 114 may further include one or more downhole sensors 140 (collectively designated by numeral 140). The sensors 140 may include any number and type of sensors 140, including, but not limited to, sensors generally known as the measurement-while-drilling (MWD) sensors or the logging-while-drilling (LWD) sensors, and sensors 140 that provide information relating to the behavior of the drilling assembly 114, such as drill bit rotation (revolutions per minute or "RPM"), tool face, pressure, vibration, whirl, bending, and stick-slip. The drilling assembly 114 may further include a controller unit 142 that controls the operation of one or more devices and sensors 140 in the drilling assembly 114. For example, the controller unit 142 may be disposed within the drill bit 116 (e.g., within a shank and/or crown of a bit body of the drill bit 116). The controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, and control downhole devices and sensors 140, and communicate data information with the surface control unit 128 via a two-way telemetry unit 150.

Figure 2:
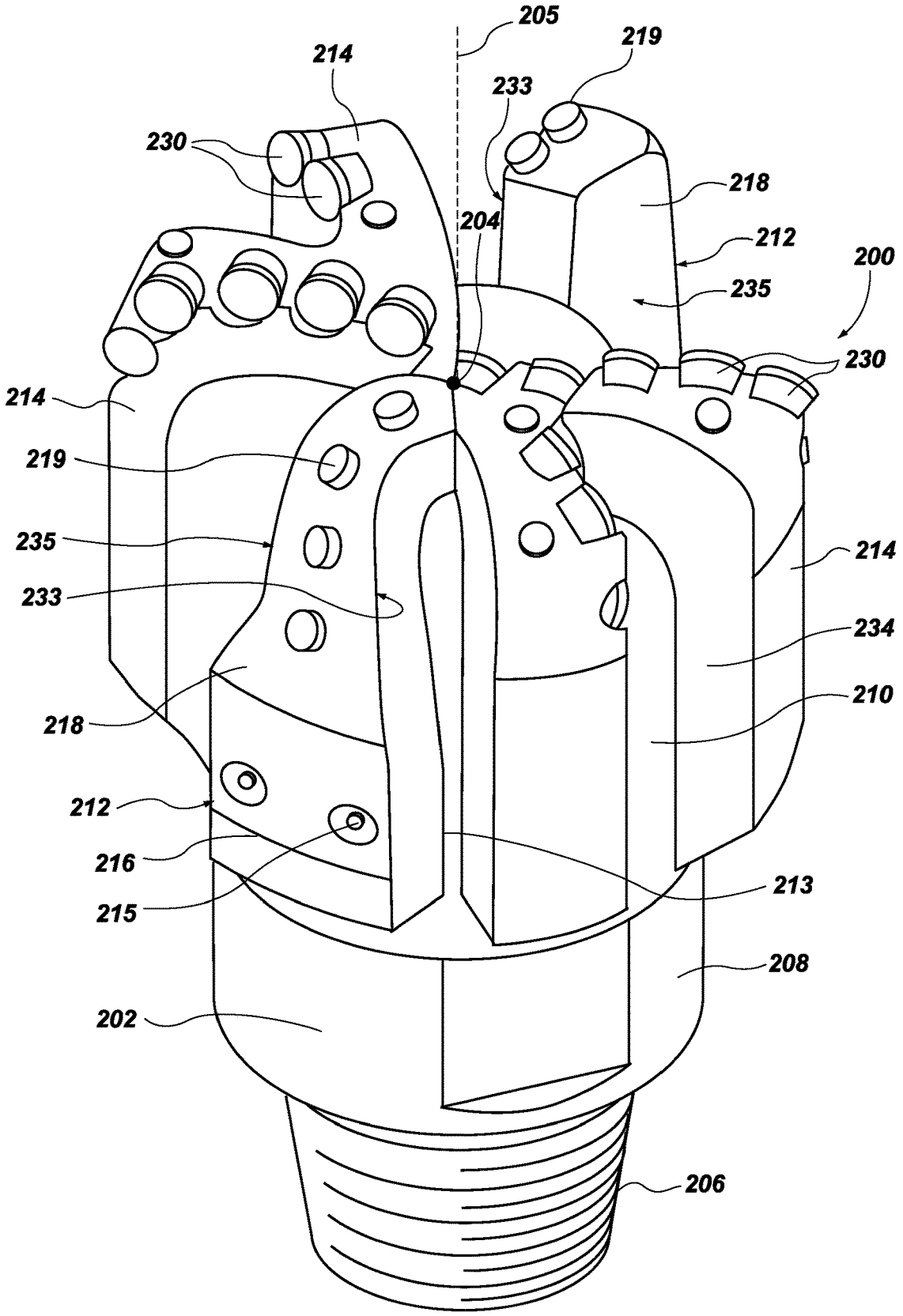
FIG. 2 is a bottom perspective view of an earth-boring tool according to one or more embodiments of the present disclosure.
Figure 3:
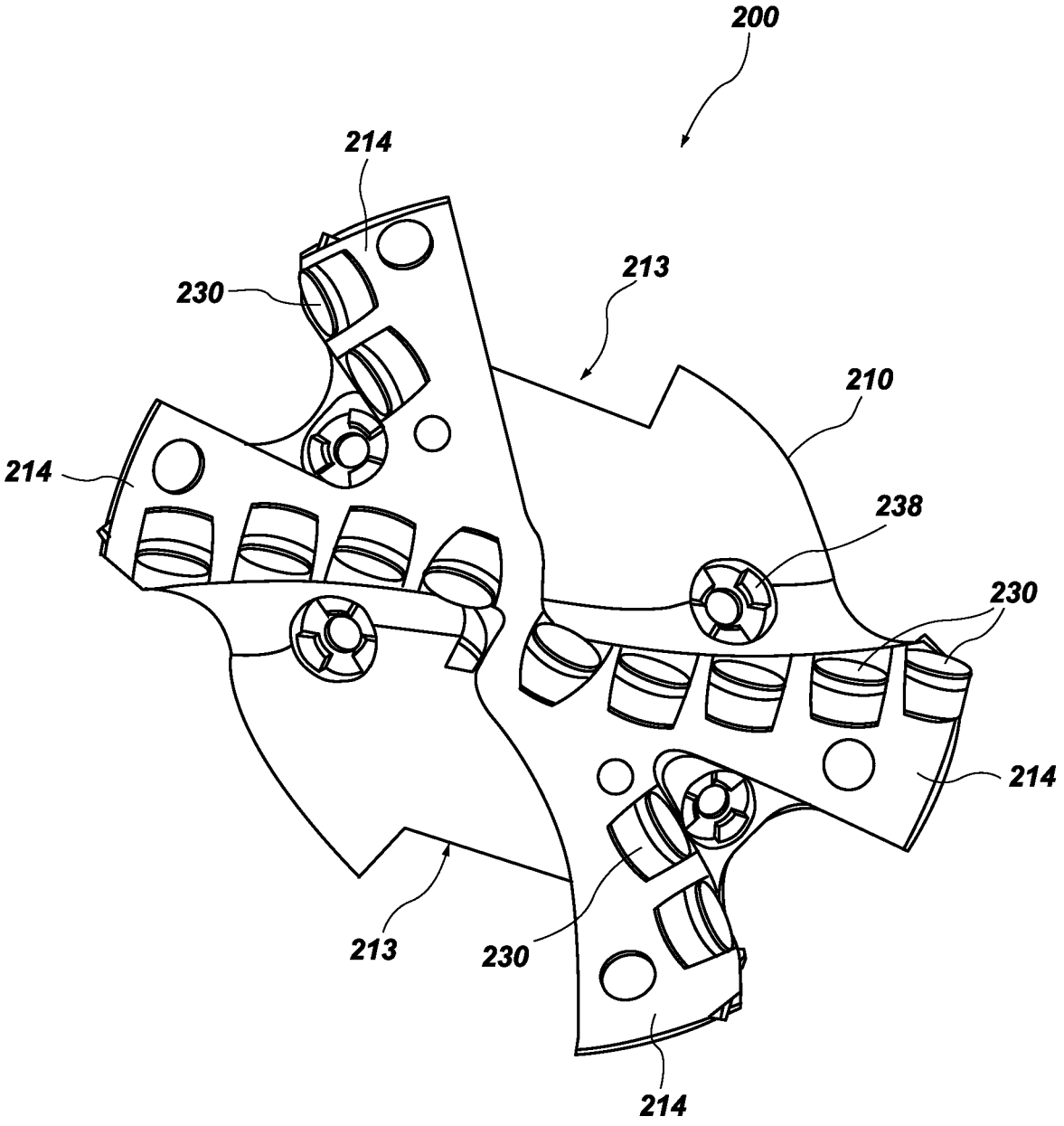
FIG. 3 is a bottom view of an earth-boring tool according to one or more embodiments of the present disclosure.

FIG. 2 is a bottom perspective view of an earth-boring tool 200 that may be used with the drilling assembly 114 of FIG. 1 according to one or more embodiments of the present disclosure. FIG. 3 is a bottom side view of the earth-boring tool 200 with one or more portions removed to better depict other portions of the earth-boring tool 200. Referring to FIGS. 2 and 3 together, the earth-boring tool 200 may include a drill bit having a plurality of fixed blades and a plurality of removable blade assemblies. For example, the earth-boring tool 200 may include a modular bit (e.g., a drill bit having both fixed blades and removable (e.g., replaceable and/or exchangeable) blade assemblies).

The earth-boring tool 200 may include a body 202 including a pin 206 (e.g., an API (American Petroleum Institute) specification pin), a shank 208, and a crown 210. In some embodiments, the bulk of the body 202 may be constructed of steel, or of a ceramic-metal composite material including particles of hard material (e.g., tungsten carbide) cemented within a metal matrix material surrounding steel reinforcing members at blade locations. The body 202 of the earth-boring tool 200 may have an axial center 204 defining a center longitudinal axis 205 that may generally coincide with a rotational axis of the earth-boring tool 200. The center longitudinal axis 205 of the body 202 may extend in a direction hereinafter referred to as an "axial direction."

The body 202 (e.g., bit body) may be connectable to a drill string 110 (FIG. 1). For example, the pin 206 of the body 202 may have a tapered end having threads thereon for connecting the earth-boring tool 200 to a box end of a drilling assembly 114 (FIG. 1). The shank 208 may include a straight section of constant diameter that is fixedly connected to the crown 210 at a joint. In some embodiments, the crown 210 may include a plurality of fixed blades 214 formed integrally with the body 202 and a plurality of receiving slots 213 formed in the body 202 of the earth-boring tool 200. The plurality of fixed blades 214 may also extend from the end of the body 202 opposite the pin 206 and may extend in both the axial and radial directions. Each fixed blade 214 may have multiple, radially extending profile regions as known in the art (cone region, nose region, shoulder region, and gage region).

Each fixed blade 214 of the plurality of fixed blades 214 of the earth-boring tool 200 may include a first plurality of cutting elements 230 fixed thereto. The first plurality of cutting elements 230 of each fixed blade 214 may be located in a row along a profile of the fixed blade 214 proximate a rotationally leading face of the fixed blade 214. In one or more embodiments, one or more of the plurality of fixed blades 214 may include cutting elements within any combination of the gage region, the shoulder region, the nose region, or the cone region. In some embodiments, the first plurality of cutting elements 230 of the plurality of fixed blades 214 may include polycrystalline diamond compact (PDC) cutting elements. Moreover, the first plurality of cutting elements 230 of the plurality of fixed blades 214 may include any suitable cutting element configurations and materials for drilling and/or enlarging boreholes.

As noted above, the earth-boring tool 200 may further include a plurality of removable blade assemblies 212 coupled to the body 202 of the earth-boring tool 200 within the one or more axially extending slots 213 formed in the body 202 of the earth-boring tool 200. Each of the plurality of removable blade assemblies 212 may include a leg 216 and a blade portion 218 extending from and connected to the leg 216. For instance, the leg 216 and the blade portion 218 of the removable blade assembly 212 may form a single integral body.

Each of the plurality of slots 213 may extend radially inward from an outer circumference of the body 202 of the earth-boring tool 200 and toward the center longitudinal axis 205 of the earth-boring tool 200. Additionally, each of the plurality of slots 213 may be sized and shaped to receive a respective leg 216 of a respective removable blade assembly 212 of the earth-boring tool 200. For instance, each of the plurality of slots 213 may form an engagement region for engaging a respective leg 216 of the removable blade assemblies 212. In some embodiments, one or more of the plurality of slots 213 may have a general dovetail-shaped cross-section or a rectangular-shaped cross-section. As a non-limiting example, the one or more slots 213 may include any of the slots and/or recesses describe in U.S. Pat. No. 8,978,786 B2, to Nguyen et al., filed Nov. 4, 2010, U.S. Pat. No. 10,107,039, to Schroder, filed May 22, 2015, or U.S. Patent Application Publication 2012/0205160 A1, to Ricks et al., filed Feb. 7, 2012, the disclosures of each of which is incorporated in their entirety by reference herein. Additionally, as is discussed in greater detail below, the legs 216 of the plurality of removable blade assemblies 212 may be secured to the body 202 of the earth-boring tool 200 via a plurality of fasteners 215. While the earth-boring tool 200 described herein in regard to FIGS. 2 and 3 is described as including fixed blades 214 and removable blade assemblies 212, the earth-boring tool 200 may further include removable rotatable cutting structure assemblies. For example, the earth-boring tool 200 may include any of the rotatable cutting structure assemblies described in U.S. Pat. No. 10,907,414 to Schoen, filed Nov. 9, 2017, the disclosure of which is incorporated in its entirety by reference herein.

Furthermore, in some embodiments, each slot 213 of the plurality of slots 213 may be formed, and as a result, each leg 216 of the plurality of removable blade assemblies 212 may be oriented more proximate a leading fixed blade 214 of the earth-boring tool 200 than a trailing fixed blade 214 of the earth-boring tool 200. Put another way, each slot 213 of the plurality of slots 213 may be formed between two adjacent fixed blades 214, and the slot 213 may be formed closer to a leading fixed blade 214 of the two adjacent fixed blades 214 than a trailing fixed blade 214 of the two adjacent fixed blades 214 in a direction of rotation of the earth-boring tool 200. In alternative embodiments, each slot 213 of the one or more slots 213 may be at least substantially centered between two adjacent fixed blades 214 in the direction of rotation of the earth-boring tool 200. In yet further embodiments, a first slot 213 of the one or more slots 213 may be at least substantially centered between a first set of two adjacent fixed blades 214, and a second slot 213 may be more proximate a leading fixed blade 214 of a second set of two adjacent fixed blades 214 than a trailing fixed blade 214 of the second set of two adjacent fixed blades 214. In yet further embodiments, a given slot 213 of the plurality of slots 213 may be formed between two adjacent fixed blades 214, and the slot 213 may be formed closer to a trailing fixed blade 214 of the two adjacent fixed blades 214 than a leading fixed blade 214 of the two adjacent fixed blades 214 in a direction of rotation of the earth-boring tool 200.

When affixed (e.g., secured) to the body 202, the plurality of legs 216 may extend longitudinally from an end of the body 202 opposite the pin 206 and may extend in the axial direction. Additionally, the blade portion 218 of each removable blade assembly 212 may also have multiple, radially extending profile regions as known in the art (cone region, nose region, shoulder region, and gage region). In some embodiments, two or more fixed blades 214 of the plurality of fixed blades 214 may be located between adjacent legs 216 of the plurality of removable blade assemblies 212.

The plurality of removable blade assemblies 212 may include a second plurality of cutting elements 219. For instance, in some embodiments, the second plurality of cutting elements 219 of each removable blade assembly 212 may be located in a row along a profile of the blade portion 218 proximate a rotationally leading face 233 of the blade portion 218. In additional embodiments, the second plurality of cutting elements 219 of each removable blade assembly 212 may be located in a row along a profile of the blade portion 218 substantially centered between the leading face 233 and a trailing face 235 of the blade portion 218. In some embodiments, the second plurality of cutting elements 219 may include less aggressive cutting elements in comparison to the cutting elements of the first plurality of cutting elements 230. For example, the second plurality of cutting elements may include one of more ovoids, conic-shaped cutting elements, wedge-shaped cutting elements, dual-chamfered cutting elements, bearing pads, or wear pads, or any other known, relatively less aggressive cutting element. As non-limiting examples, the second plurality of cutting elements 219 may include any of the cutting elements described in U.S. Pat. No. 10,954,721, to Russell et al., filed Jun. 11, 2018, U.S. Pat. No. 10,697,248 to Russell et al., filed Oct. 4, 2017, U.S. Pat. No. 9,316,058, to Bilen et al., filed Feb. 8, 2013, U.S. Pat. No. 9,074,435, to Scott et al., filed Apr. 29, 2011, U.S. Pat. No. 8,240,403, to Trinh et al., filed Oct. 8, 2010, U.S. Pat. No. 8,061,456, to Patel et al., filed Aug. 26, 2008, U.S. Pat. No. 6,935,441, to Dykstra et al., filed Jun. 4, 2004, U.S. Pat. No. 6,779,613, to Dykstra et al., filed Oct. 7, 2002, U.S. Pat. No. 6,460,631, to Dykstra et al., filed Dec. 15, 2000, U.S. Pat. No. 6,332,503, to Tessier et al., filed Dec. 15, 1998, U.S. Pat. No. 6,298,930, to Sinor et al., filed Aug. 26, 1999, U.S. Pat. No. 6,098,730, to Scott et al., filed May 7, 1998, U.S. Pat. No. 5,855,247, to Scott et al., filed Feb. 14, 1997, U.S. Pat. No. 5,746,280, to Scott et al., filed Aug. 12, 1996, U.S. Pat. No. 5,323,865, to Isbell et al., filed Dec. 17, 1992, or U.S. Patent Publication 2009/0159341 A1 to Pessier et all, filed Dec. 22, 2008 the disclosures of each of which are incorporated in their entirety by reference herein.

In one or more embodiments, one or more of the blade portions 218 of the plurality of removable blade assemblies 212 may include cutting elements within any combination of the gage region, the shoulder region, the nose region, or the cone region. Furthermore, as is described in further detail below, the locations and orientations of the second plurality of cutting elements 219 on the blade portions 218 of the plurality of removable blade assemblies 212 and the types of cutting elements of the second plurality of cutting elements may be selected to selectively remove formation material from particular regions and/or to adjust an aggressiveness of the respective removable blade assembly 212 or the overall earth-boring tool 200.

Additionally, in some embodiments, one or more of the blade portions 218 and the second plurality of cutting elements 219 may be offset axially relative to axial positions of the cutting elements of the first plurality of cutting elements 230 and/or the fixed blades 214. In other words, one or more of the blade portions 218 of the plurality of the removable blade assemblies 212 and the second plurality of cutting elements 219 may be less prominent and/or may not extend to a same axial position as the lowermost faces of the fixed blades 214 and/or the same axial positions of cutting edges of the first plurality of cutting element 230. As a result, in operation, the blade portions 218 of the removable blade assemblies 212 and the second plurality of cutting elements 219 may engage a formation a different amount relative to (e.g., less or more than) cutting elements of the first plurality of cutting elements 230 and/or the fixed blades 214. Additionally, as is described in greater detail below, the second plurality of cutting elements 219 and the blade portions 218 may control a depth of cut of the first plurality of cutting elements 230 and the fixed blades 214, which, in turn, may at least partially control an aggressiveness (e.g., an overall aggressiveness) of the earth-boring tool 200.

As noted above, the plurality of fasteners 215 may be utilized to secure the legs 216 of the plurality of removable blade assemblies 212 to the body 202 of the earth-boring tools 200. In some embodiments, the plurality of fasteners 215 may include one or more of mechanical fasteners (e.g., bolts or stud/nut combinations), metallurgical/chemical fasteners (e.g., welding, brazing, gluing or amorphous diffusion bonding), or a combination of mechanical and metallurgical/chemical fastening systems. As a non-limiting example, the plurality of fasteners 215 may be utilized to secure the legs 216 of the plurality of removable blade assemblies 212 to the body 202 of the earth-boring tool 200 via any of the manners described in U.S. Pat. No. 8,978,786 B2, to Nguyen et al., filed Nov. 4, 2010, U.S. Pat. No. 10,107,039, to Schroder, filed May 22, 2015, or U.S. Patent Application Publication 2012/0205160 A1, to Ricks et al., filed Feb. 7, 2012, the disclosures of each of which is incorporated in their entirety by reference herein. Furthermore, the plurality of fasteners 215 may include any of the fasteners described in the foregoing referenced disclosures.

Fluid courses 234 may be formed between adjacent fixed blades 214 of the plurality of fixed blades 214 and/or between adjacent fixed blades 214 and removable blade assemblies 212 and may be provided with drilling fluid by ports located at the end of passages leading from an internal fluid plenum extending through the body 202 from tubular shank 208 at the upper end of the earth-boring tool 200. Nozzles 238 may be secured within the ports for enhancing direction of fluid flow and controlling flow rate of the drilling fluid. The fluid courses 234 extend to junk slots extending axially along the longitudinal side of earth-boring tool 200 between fixed blades 214 of the plurality of fixed blades 214.

Figure 4:
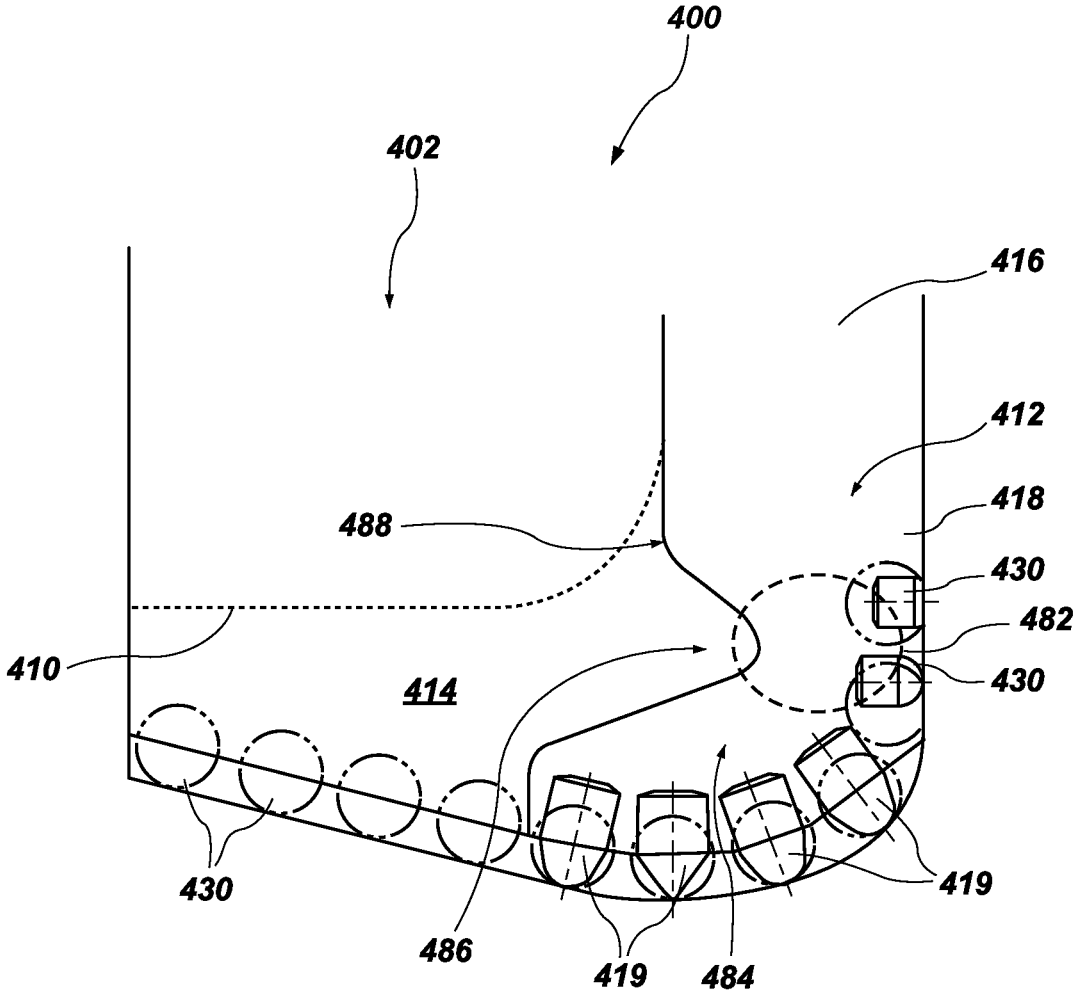
FIG. 4 is a side view cross-section view of an earth-boring tool according to one or more embodiments of the present disclosure.

FIG. 4 is side cross-sectional view of a blade portion 418 of a removable blade assembly 412 coupled to a body 402 of an earth-boring tool 400 according to one or more embodiments of the present disclosure. As shown in FIG. 4, in some embodiments, the blade portion 418 may include a narrowed region 482 (e.g., a necked or reduced region) of material proximate a gage or shoulder region of a blade profile of the blade portion 418. The narrowed region 482 may enable a lower portion (referred to herein as "engagement region 484") of the blade portion 418 (e.g., a portion engaging a formation) to deflect relative to a remainder of the blade portion 418 and leg 416 of the removable blade assembly 412. In particular, during operation and when a force (e.g., an axial force) is applied to the earth-boring tool 400 and the removable blade assembly 412, such WOB during a drilling operation, the engagement region 484 of the blade portion 418 may deflect or bend about the narrowed region 482. In other words, the narrowed region 482 may act as a hinge between the engagement region 484 of the blade portion 418 and a remainder of the blade portion 418 and leg 416 of the removable blade assembly 412. The resulting deflection may change an exposure of other blades of the earth-boring tool 400, such as the fixed blades 414 of the earth-boring tool 400, to material of the formation. Thus, a contact area between the fixed blades 414 and/or other blades of the earth-boring tool 400 and the formation (e.g., in contact with and rubbing on the formation) may be varied (e.g., increased or decreased) by varying the WOB applied to the earth-boring tool. Accordingly, an aggressiveness of the earth-boring tool 400 may be increased by causing the engagement region 484 of the blade portion 418 to deflect relative to a remainder of the blade portion 418 and leg 416 of the removable blade assembly 412 (e.g., deflect in a direction away from a contacted formation and responsive to an experienced force).

In some embodiments, the narrowed region 482 of the blade portion 418 may be at least partially defined by a recess 486 formed in the blade portion 418 of the removable blade assembly 412, and the recess 486 may extend from a radially innermost surface 488 of the blade portion 418 radially outward into the blade portion 418. In some embodiments, the recess 486 may be formed within or proximate the shoulder region and/or the gage region of the blade portion 418 of the removable blade assembly 412. In one or more embodiments, the recess 486 may have a general triangular cross-section. For instance, the recess 486 may have a rounded triangular cross-section, as depicted in FIG. 4.

Referring still to FIG. 4, in some embodiments, an amount by which the engagement region 484 deflects (e.g., displaces) under a given load (e.g., WOB) may be selected by selecting one or more of a stiffness, a modulus of elasticity, and/or a modulus of rigidity of a material of the narrowed region 482 and/or the blade portion 418 of the removable blade assembly 412. In some embodiments, the narrowed region 482 and/or the blade portion 218 may have an axial stiffness and a rotational or tangential stiffness. Furthermore, in some embodiments, one or more of the stiffness (e.g., axial and/or rotational stiffness), the modulus of elasticity, and/or the modulus of rigidity of the material of the narrowed region 482 and/or the blade portion 418 of the removable blade assembly 412 may be selected such that a deflection or displacement distance versus a load curve is at least substantially linear over an expected load (e.g., WOB) range for a given drilling operation. In other embodiments, one or more of the stiffness (axial and/or rotational), the modulus of elasticity, and/or the modulus of rigidity of the material of the narrowed region 482 and/or the blade portion 418 of the removable blade assembly 412 may be selected such that a deflection or displacement distance versus a load curve is at least substantially nonlinear over an expected load (e.g., WOB) range for a given drilling operation.

As will be understood by one of ordinary skill in the art, a stiffness of a structure (e.g., the narrowed region 482, the blade portion 418, and/or the leg 416 of the removable blade assembly 412) may be determined at least in part by a modulus of elasticity of material of which the structure is made. As used here, the term "modulus of elasticity" is synonymous with the term "Young's modulus," and is defined as the slope of the stress-strain curve in the elastic deformation region of the material. The modulus of elasticity is a material property and may be a function of temperature and rate of deformation. In some materials, the modulus of elasticity may decrease with increasing temperature, meaning that a given body may deform more under a given load at a higher temperature than under the same given load at a lower temperature. For example, a component of the earth-boring tool 400 (e.g., a removable blade assembly 412, etc.) may be formed of a material having a lower elastic modulus at a selected temperature (e.g., at 23° C.) than a material of other components or structures having a higher stiffness (e.g., a fixed blade). For example, an earth-boring tool 400 may have a fixed blade 414 formed of a material having an elastic modulus 50% higher than the material of a removable blade assembly 412 of the earth-boring tool 400, or formed of a material having an elastic modulus 100% higher than the material of a removable blade assembly 412 of the earth-boring tool 400. In one or more embodiments, the removable blade assemblies 412 of the earth-boring tool 400 may be formed of various materials, such as aluminum, steel, composite materials, matrix materials, etc.

Referring to FIGS. 1-4 together, in some embodiments, the plurality of blade portions 218, 418 and the plurality of removable blade assemblies 212, 412 may act as depth-of-cut limiters to control the aggressiveness of the earth-boring tool 200, 400 and/or ROP of the earth-boring tool 200, 400. For example, as WOB increases on the earth-boring tool 200, 400 an amount by which the engagement region 484 deflects may increase, which may increase the depth of cut of the first plurality of cutting elements 230 of the fixed blades 214, 414.

Furthermore, the earth-boring tool 200 may include a plurality of blade portions 218, 418 having differing stiffnesses, moduli of elasticity, and/or moduli of rigidity relative to one another. As a result, an aggressiveness of the earth-boring tool may be varied (e.g., selected) by varying (e.g., selecting) the WOB. Furthermore, by enabling aggressiveness of the earth-boring tool 200, 400 to be varied and/or controlled via a load, the earth-boring tools 200, 400 and the removable blade assemblies 212, 412 may provide further advantages over conventional earth-boring tools. For instance, enabling aggressiveness of the earth-boring tool 200, 400 to be varied and/or controlled via a load may provide improved tool face control, which may enable a higher rate of penetration (ROP) and improved efficiency and dynamics of the earth-boring tool 200, 400 in comparison to conventional earth-boring tools. Additionally, enabling aggressiveness of the earth-boring tool 200, 400 to be varied and/or controlled via a load may reduce and/or eliminate a necessity to change drill bits during a drilling operation to select an aggressiveness and may reduce time required to form (e.g., drill) a wellbore while reducing costs and increasing operational flexibility (e.g., the ability to adjust drilling parameters during operation in response to data collected). Furthermore, enabling aggressiveness and a depth-of-cut of the earth-boring tool 200, 400 to be varied and/or controlled via a load may provide advantages not only in vertical boreholes (e.g., wells), but may also provide advantages in directional and horizontal boreholes and drilling operations. For instance, in relatively harder formations (e.g., rock), torque requirements for higher depths-of-cut often exceed the capacity of the drill string and the downhole motors, particularly for relatively larger diameter bits. The foregoing can lead to stick slip and other dynamic problems. Additionally, in softer, more plastic formations (e.g., shales), excessive depth-of-cut generates large cutting and shavings, which can ball up the earth-boring tool (e.g., bit), and mud circulation systems are inefficient in cleaning the boreholes, particularly in horizontal wells. By providing removable blade assemblies and enabling aggressiveness and a depth-of-cut of the earth-boring tool 200, 400 to be varied and/or controlled via a load due to the removable blade assemblies, the foregoing described issues and problems can be mitigated and/or eliminated by selecting appropriate removable blade assemblies for the given formation and borehole type.

Referring still to FIGS. 1-4, because the plurality of removable blade assemblies 212, 412 are removable, one or more of the removable blade assemblies 212, 412 may be relatively easily removed and replaced. As a result, removable blade assemblies having particular cutting elements, shapes, and configurations may be selected in order to select an overall aggressiveness of the earth-boring tool 200, 400 for a given load range. Furthermore, because the plurality of removable blade assemblies 212, 412 are removable, an overall aggressiveness of the earth-boring tool 200, 400 for a given load range may be relatively easily adjusted by replacing one or more of the plurality of removable blade assemblies 212, 412. Moreover, because the plurality of removable blade assemblies 212, 412 are removable, portions of the earth-boring tool 200, 400 may be relatively easily repaired by replacing one or more of the plurality of removable blade assemblies 212, 412.

Moreover, because the plurality of removable blade assemblies 212, 412 are removable, one or more of the plurality of removable blade assemblies 212, 412 may be relatively easily removed and replaced with rotatable cutting structure (e.g., roller cone) assemblies. By replacing one or more of the plurality of removable blade assemblies 212, 412 with a roller cone, an overall aggressiveness of the earth-boring tool 200, 400 may be adjusted.

Figure 5:
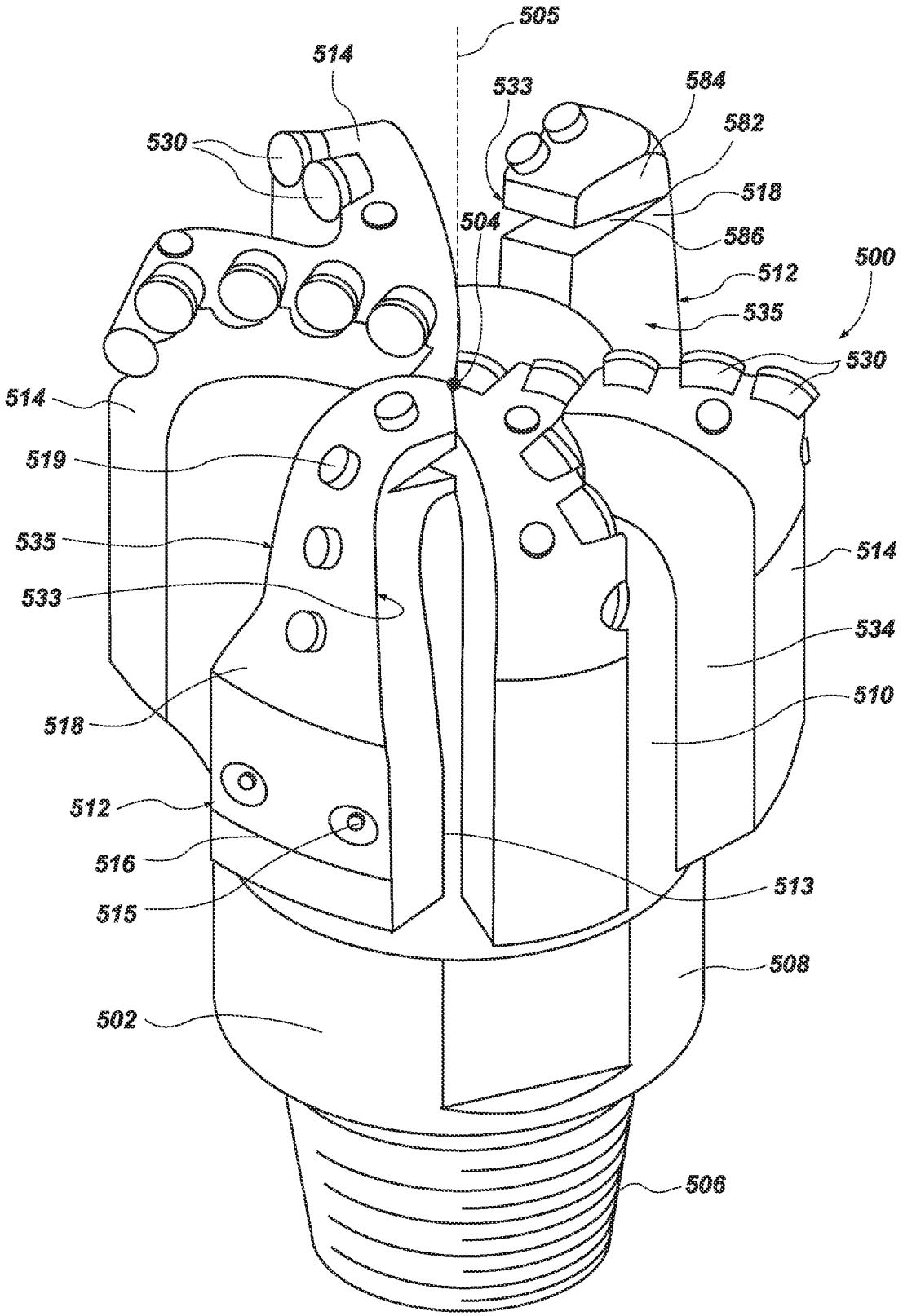
FIG. 5 is a bottom view of another earth-boring tool according to one or more embodiments of the present disclosure.

FIG. 5 is a perspective view of an earth-boring tool 500 having a plurality of removable blade assemblies 512 coupled to the body 502 of the earth-boring tool 500 within the one or more axially extending slots 513 formed in the body 502 of the earth-boring tool 500 according to one or more additional embodiments of the present disclosure. Similar to the blade portions 418 of the removable blade assemblies 412 described above in regard to FIG. 4, the blade portions 518 of the removable blade assemblies 512 may include a narrowed region 582 and associated recess 586. However, the recess 586 may have a relatively narrow triangular cross-section. The plurality of removable blade assemblies 512 described in regard to FIG. 5 may provide at least substantially the same advantages as the removable blade assemblies 412 described above in regard to FIG. 4.

Referring to FIGS. 4 and 5, in some embodiments, one or more of the engagement regions 484, 584 of the plurality of removable blade assemblies 412, 512 may overhang a portion of the crown 410, 510 of the earth-boring tool 200. For example, one or more of the engagement regions 484, 584 of the plurality of removable blade assemblies 412, 512 may jut (e.g., project) out over a portion of the crown 410, 510 of the earth-boring tool 400, 500 from the remainders of the blade portions 418, 518 of the plurality of removable blade assemblies 412, 512. For instance, such engagement regions 484, 584 may extend through a gage region, a shoulder region, and one or more of a nose region and a cone region of the earth-boring tool 200. Additionally, in one or more embodiments, one or more of the engagement regions 484, 584 of the plurality of removable blade assemblies 412, 512 may not overhang a portion of the crown 410, 510 of the earth-boring tool 200. For example, in such embodiments, one or more of the engagement regions 484, 584 of the plurality of removable blade assemblies 412, 512 may be at least substantially axially aligned with the remainders of the blade portions 418, 518 of the plurality of removable blade assemblies 412, 512. For instance, such engagement regions 484, 584 may only extend through a gage region and a shoulder region of the earth-boring tool 400, 500.

Figure 6:
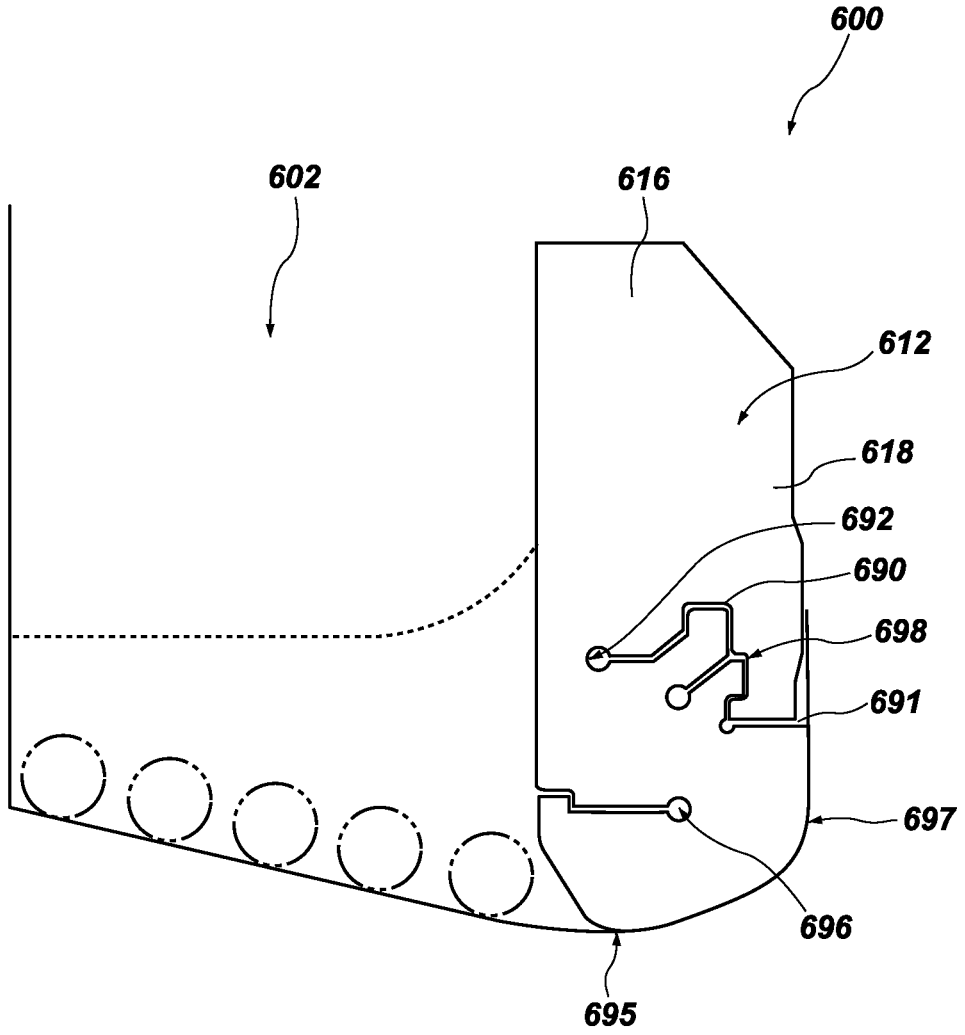
FIG. 6 is a side view cross-section view of another earth-boring tool according to one or more embodiments of the present disclosure.
Figure 8:
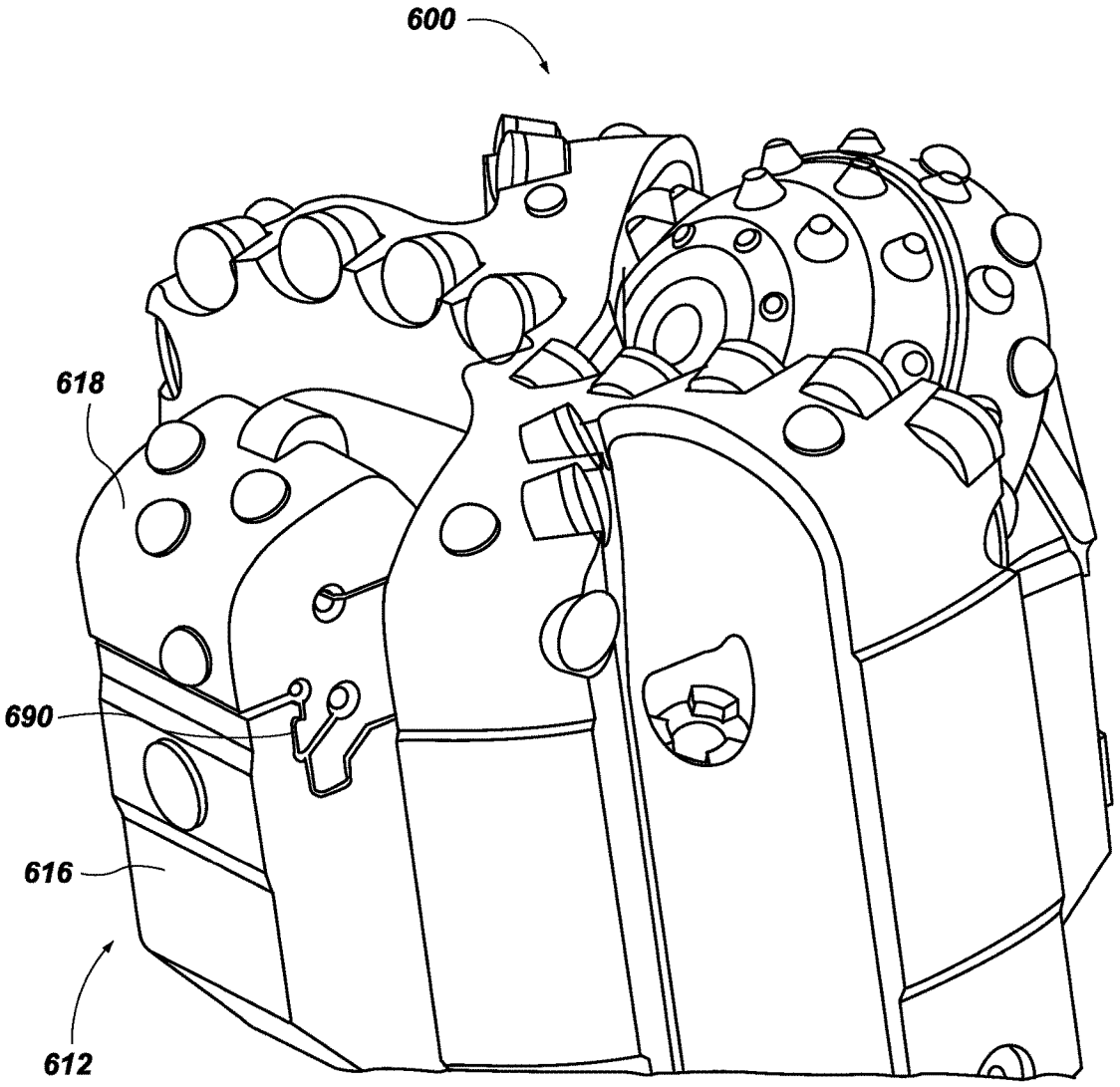
FIG. 8 is a perspective view of a removable blade assembly of FIG. 6.
Figure 7:
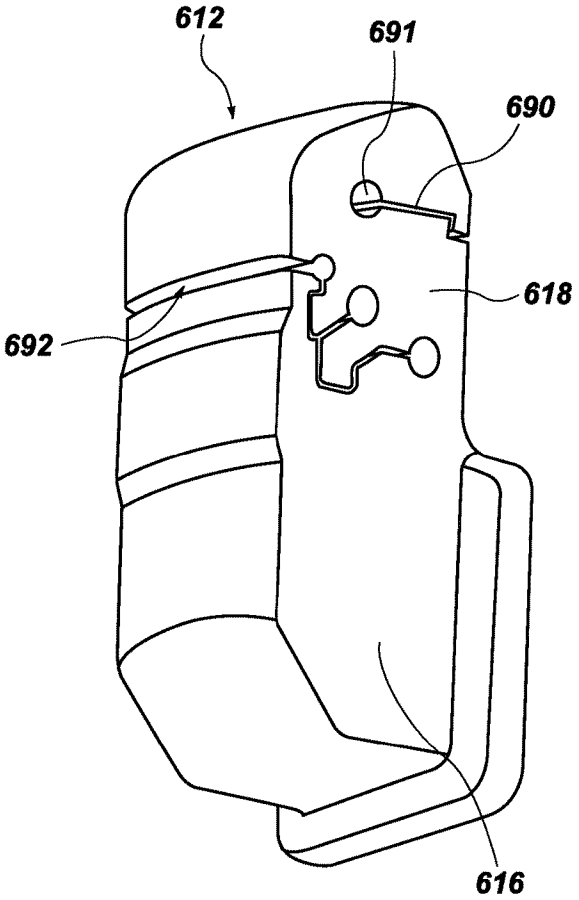
FIG. 7 is a bottom perspective view of the earth-boring tool of FIG. 6.

FIG. 6 is a side cross sectional view of an earth-boring tool 600 and removable blade assembly 612 according to one or more embodiments of the present disclosure. FIG. 7 is a perspective view of the removable blade assembly 612 of FIG. 6. FIG. 8 is a perspective view of the earth-boring tool 600 and the removable blade assembly 612 of FIG. 6.

Referring to FIGS. 6-8 together, in some embodiments, a blade portion 618 of the removable blade assembly 612 may have a generally uniform outer peripheral shape along an axial length of the blade portion 618 of the removable blade assembly 612. The removable blade assembly 612 may include a plurality of passageways 690 defined within the blade portion 618 and/or the leg 616 of the removable blade assembly 612. The plurality of passageways 690 may extend completely through the blade portion 618 and/or the leg 616 of the removable blade assembly 612 in a lateral direction (e.g., in a direction of rotation of the earth-boring tool 600).

In some embodiments, the plurality of passageways 690 may define spaces 691 between various portions of the blade portion 618 and/or the leg 616 of the removable blade assembly 612. For example, the spaces 691 may include gaps, voids, inner pathways, slots, holes, etc. formed within the blade portion 618 and/or the leg 616 of the removable blade assembly 612. Furthermore, the passageways 690 may include interior surfaces 692 defining the spaces 691. In some embodiments, the interior surfaces 692 may include flat and/or curved surfaces. Moreover, some interior surfaces 692 may define one or more substantially planar spaces, cylindrical spaces, ovoid spaces, elliptical cylinder spaces, triangular prism spaces, rectangular prism spaces, etc. In some embodiments, one or more of the plurality of passageways 690 may be connected together. In some embodiments, one or more of the plurality of passageways 690 may define spaces 691 extending in directions to which forces, that are expected to be experienced during drilling operations, are likely to be normal. As a result, when the forces are experienced during drilling operations, the spaces 691 may enable the blade portion 618 and/or the leg 616 of the removable blade assembly 612 to flex (e.g., deflect or bend) and may provide any of the advantages described above in regard to FIGS. 1-5. Furthermore, the plurality of passageways 690 may reduce an overall stiffness of ore or more portions of the blade portion 618 and/or the leg 616 of the removable blade assembly 612.

In some embodiments, the plurality of passageways 690 may be formed by machining, such as by drilling, milling, etc. In additional embodiments, the plurality of passageways 690 may be formed by casting material of the blade portion 618 and/or the leg 616 of the removable blade assembly 612 around a removable (i.e., sacrificial) material, and subsequently removing the removable material.

In one or more embodiments, the plurality of passageways 690 may be configured to create or cause one or more load/deflection characteristics. For example, during a drilling operations, the blade portion 618 and/or the leg 616 of the removable blade assembly 612 may experience one or more forces that cause the blade portion 618 and/or the leg 616 of the removable blade assembly 612 to flex (e.g., deflect or bend), which in turn, may cause a volume of one or more of the plurality of passageways 690 to decrease. As a result, opposing interior surfaces 692 may contact each other. In some embodiments, an amount interior surfaces 692 deflects responsive to an external force (e.g., WOB) may have a substantially linear relationship with the external force.

Furthermore, in some embodiments, the removable blade assembly 612 may exert a resistance force on a formation, and the resistance force may increase in a stepped manner when opposing interior surfaces 692 contact each other. For example, a resistance force exerted by a removable blade assembly 612 may increase substantially linearly with an increase in WOB up to an instance when opposing interior surfaces 692 contact one another of a given passageway 690 of the plurality of passageways 690. Upon opposing interior surfaces 692 contacting each another, the removable blade assembly 612 may exert a relatively larger resistance force on a formation responsive to the WOB. For example, the resistance force exerted by a removable blade assembly 612 having collapsed passageways 690 may be similar to the resistance force of a removable blade assembly without passageways 690. As will be understood by one of ordinary skill in the art, the collapse of passageways 690 may be reversible (e.g., reversible via elastic deformation), such that when WOB is reduced, the interior surfaces 692 separate from one another and the resistance force exerted by the removable blade assembly 612 reduces.

As is shown in FIGS. 6-8, the removable blade assembly 612 may include a plurality of passageways 690, and as such, the removable blade assembly 612 may be configured to flex (e.g., deflect) in a plurality of directions and at a plurality of locations within the removable blade assembly 612. As a result, the removable blade assembly 612 may be configured to respond to various forces experienced in various directions during operation. For example, as shown in FIG. 6, a first force 695 acting on the nose region of the removable blade assembly 612 may cause a first set of spaces 696 to change in volume, whereas a second force 697 acting on the shoulder or gage region of the removable blade assembly 612 may cause a different or additional set of spaces 698 to change in volume (e.g., increase or decrease in volume). Therefore, the removable blade assembly 612 may deflect in a plurality of directions and a plurality of locations to accommodate normal, rotational, and/or shear forces.

Furthermore, as is discussed above, deflection of the blade portion 618 and/or the leg 616 of the removable blade assembly 612 may change an aggressiveness of the blade portion 618 and/or the leg 616 of the removable blade assembly 612 and/or of the earth-boring tool 600. For example, the aggressiveness of the blade portion 618 and/or the leg 616 of the removable blade assembly 612 and/or of the earth-boring tool 600 may be changed via any of the manners described above in regard to FIGS. 1-5.

Referring to FIGS. 1-8 together, some embodiments of the present disclosure include a modular earth-boring tool having a body having one or more fixed blades configured to remove formation material from one or more regions a formation, and one or more removable blade assemblies or removable rotatable cutting structure assemblies configured to remove formation material from one or more regions of the formation. The removable assemblies (e.g., blades or rotatable cutting structures) may be coupled to a body (e.g., a bit body) of the earth-boring tool in removable manner thereby allowing the removable assemblies to be exchanged as desired. For example, one or more of the removable assemblies may be exchanged in the field before or after the earth-boring tool is operated downhole based on changing downhole conditions. Additionally, one or more of the removable assemblies may be changed (i.e., modified) or replaced after the earth-boring tool has been tripped out of the borehole to change or replace removable assemblies. Furthermore, the modular earth-boring tool may have a predetermined aggressiveness (e.g., an aggressiveness characteristic) that varies as a function of loading, such as WOB. Moreover, the removable assemblies of the earth-boring tool may include materials exhibiting a stiffness, a modulus of elasticity, and/or a modulus of rigidity that enables the removable assemblies to flex during operation and, as a result, enables an aggressiveness of the earth-boring tool to change based at least partially on loading on the earth-boring tool. In addition or alternately, the fixed blades of the earth-boring tool may include materials exhibiting a stiffness, a modulus of elasticity, and/or a modulus of rigidity that enables the fixed blades to flex during operation and, as a result, enables an aggressiveness of the earth-boring tool to change based at least partially on loading on the earth-boring tool.

Embodiments of the Present Disclosure Further Include:

Embodiment 1. An earth-boring tool, comprising: a body; a plurality of fixed blades extending from the body; a first plurality of cutting elements secured to the plurality of fixed blades; a plurality of removable blade assemblies removably coupled to the body; and a second plurality of cutting elements secured to the plurality of removable blade assemblies, a second plurality of cutting elements secured to the plurality of removable blade assemblies, the plurality of removable blade assemblies exhibiting an aggressiveness that is different than an aggressiveness of the fixed blades.

Embodiment 2. The earth-boring tool of embodiment 1, further comprising a plurality of slots, each slot of the plurality of slots correlating to and configured to receive a respective removable blade assembly of the plurality of removable blade assemblies.

Embodiment 3. The earth-boring tool of any one of embodiments 1 and 2, wherein each removable blade assembly of the plurality of removable blade assemblies comprises a leg and blade portion extending from the leg.

Embodiment 4. The earth-boring tool of embodiment 3, wherein a blade portion of at least one removable blade assembly of the plurality of removable blade assemblies comprises: a narrowed region proximate a gage region or a shoulder region of the blade portion; and an engagement region extending from the narrowed region.

Embodiment 5. The earth-boring tool of embodiment 4, wherein the engagement region deflects a distance about the narrowed region responsive to weight-on-bit, an amount of deflection of the engagement region having a linear relationship to a defined range of weight-on-bit.

Embodiment 6. The earth-boring tool of embodiment 4, wherein the engagement region deflects a distance about the narrowed region responsive to weight-on-bit, an amount of deflection of the engagement region having a nonlinear relationship to a defined range of weight-on-bit.

Embodiment 7. The earth-boring tool of any one of embodiments 1 through 6, wherein each removable blade assembly comprises a material exhibiting a modulus of elasticity enabling an aggressiveness of the removable blade assembly to be selected based on a weight-on-bit.

Embodiment 8. The earth-boring tool of any one of embodiments 1 through 7, wherein at least one removable blade assembly of the plurality of removable blade assemblies comprises a plurality of passageways formed within the at least one removable blade assembly.

Embodiment 9. The earth-boring tool of any one of embodiments 1 through 8, wherein a first cutting profile of a first removable blade assembly of the plurality of removable blade assemblies extends from a gage region and through a nose region of the earth-boring tool and a second cutting profile of a second removable blade assembly of the plurality of removable blade assemblies extends from the gage region only to a shoulder region of the earth-boring tool.

Embodiment 10. The earth-boring tool of any one of embodiments 1 through 9, further comprising a plurality of fasteners removably coupling the plurality of removable blade assemblies to the body.

Embodiment 11. The earth-boring tool of embodiment 10, wherein the plurality of fasteners comprises one or more of mechanical fasteners, metallurgical/chemical fasteners, or a combination of mechanical and metallurgical/chemical fasteners.

Embodiment 12. The earth-boring tool of any one of embodiments 1 through 11, wherein at least one removable blade assembly of the plurality of removable blade assemblies is closer to a leading fixed blade of the plurality of fixed blades than a trailing blade of the plurality of fixed blades in a direction of rotation of the earth-boring tool.

Embodiment 13. The earth-boring tool any one of embodiments 1 through 12, wherein the removable blade assemblies of the are configured to flex to enable an overall aggressiveness of the earth-boring tool be selected throughout a range of weight-on-bit for a drilling operation.

Embodiment 14. A removable blade assembly configured to be removably coupled to a body of an earth-boring tool, the removable blade assembly comprising: a leg configured to be received within a receiving slot of the body of the earth-boring tool; a blade portion extending from the leg; the blade portion comprising: a narrowed region proximate a gage region or a shoulder region of the blade portion; and an engagement portion extending from the narrowed region.

Embodiment 15. The removable blade assembly of claim 14, further comprising a plurality of passageways formed within one or more of the blade portion and the leg of the removable blade assembly.

Embodiment 16. The removable blade assembly of any one of embodiments 14 and 15, further comprising a plurality of cutting elements secured to the blade portion.

Embodiment 17. The removable blade assembly of embodiment 16, wherein the plurality of cutting elements comprises one or more ovoids, conic-shaped cutting elements, wedge-shaped cutting elements, dual-chamfered cutting elements, bearing pads, or wear pads.

Embodiment 18. The removable blade assembly of any one of embodiments 14 through 17, wherein the engagement region is configured to deflect about the narrowed region responsive to experiencing a force on the engagement region.

Embodiment 19. A method of forming an earth-boring tool, comprising: forming a body and a plurality of fixed blades extending from the body; securing a first plurality of cutting elements to the plurality of fixed blades; removably coupling at least one removable blade assembly to the body; and securing a second plurality of cutting elements to the at least one removable blade assembly, the removable blade assemblies exhibiting an aggressiveness that is different than an aggressiveness of the plurality of fixed blades.

Embodiment 20. The method of embodiment 19, wherein removably coupling at least one removable blade assembly to the body comprises: inserting a leg of the at least one removable blade assembly into a slot of the body; and securing the at least one removable blade assembly via one or more fasteners.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those skilled in the art from the description. Such modifications and embodiments also fall within the scope of the appended claims and equivalents.

What is claimed is:

1. An earth-boring tool, comprising:

a body;

a plurality of fixed blades extending from the body;

a first plurality of cutting elements secured to the plurality of fixed blades;

a plurality of removable blade assemblies removably coupled to the body; and a second plurality of cutting elements secured to the plurality of removable blade assemblies, the plurality of removable blade assemblies exhibiting an aggressiveness that is different than an aggressiveness of the plurality of fixed blades, wherein a blade portion of at least one of the plurality of removable blade assemblies is configured to deflect responsive to a Weight-on-Bit (WOB) and change exposure to at least one other blade of the earth-boring tool responsive to a change to the WOB.

2. The earth-boring tool of claim 1, further comprising a plurality of slots, each slot of the plurality of slots correlating to and configured to receive a respective removable blade assembly of the plurality of removable blade assemblies.

3. The earth-boring tool of claim 1, wherein each removable blade assembly of the plurality of removable blade assemblies comprises a leg and the blade portion extending from the leg.

4. The earth-boring tool of claim 3, wherein the blade portion of the at least one of the plurality of removable blade assemblies comprises:

a narrowed region proximate a gage region or a shoulder region of the blade portion; and an engagement region extending from the narrowed region.

5. The earth-boring tool of claim 4, wherein the engagement region deflects a distance about the narrowed region responsive to the WOB to the change to the exposure to the at least one other blade of the earth-boring tool, an amount of deflection of the engagement region having a linear relationship to a defined range of the WOB.

6. The earth-boring tool of claim 4, wherein the engagement region deflects a distance about the narrowed region responsive to the WOB, an amount of deflection of the engagement region having a nonlinear relationship to a defined range of weight-on-bit.

7. The earth-boring tool of claim 1, wherein each removable blade assembly comprises a material exhibiting a modulus of elasticity enabling an aggressiveness of the removable blade assembly to be selected based on the WOB.

8. The earth-boring tool of claim 1, wherein at least one removable blade assembly of the plurality of removable blade assemblies comprises a plurality of passageways formed within the at least one removable blade assembly.

9. The earth-boring tool of claim 1, wherein a first cutting profile of a first removable blade assembly of the plurality of removable blade assemblies extends from a gage region and through a nose region of the earth-boring tool and a second cutting profile of a second removable blade assembly of the plurality of removable blade assemblies extends from the gage region only to a shoulder region of the earth-boring tool.

10. The earth-boring tool of claim 1, further comprising a plurality of fasteners removably coupling the plurality of removable blade assemblies to the body.

11. The earth-boring tool of claim 10, wherein the plurality of fasteners comprises one or more of mechanical fasteners, metallurgical/chemical fasteners, or a combination of mechanical and metallurgical/chemical fasteners.

12. The earth-boring tool of claim 1, wherein at least one removable blade assembly of the plurality of removable blade assemblies is closer to a fixed blade of the plurality of fixed blades leading at least one removable blade than the fixed blade of the plurality of fixed blades trailing the at least one removable blade in a direction of rotation of the earth-boring tool.

13. The earth-boring tool of claim 1, wherein the removable blade assemblies of the plurality are configured to flex to enable an overall aggressiveness of the earth-boring tool be selected throughout a range of the WOB for a drilling operation.

14. A removable blade assembly configured to be removably coupled to a body of an earth-boring tool, the removable blade assembly comprising:

a leg configured to be received within a receiving slot of the body of the earth-boring tool;

a blade portion extending from the leg, the blade portion comprising:

a narrowed region proximate a gage region or a shoulder region of the blade portion; and an engagement portion extending from the narrowed region, the blade portion configured to deflect responsive to a Weight-on-Bit (WOB) and change exposure to at least one other blade of the earth-boring tool responsive to a change to the WOB.

15. The removable blade assembly of claim 14, further comprising a plurality of passageways formed within one or more of the blade portion and the leg of the removable blade assembly.

16. The removable blade assembly of claim 14, further comprising a plurality of cutting elements secured to the blade portion.

17. The removable blade assembly of claim 16, wherein the plurality of cutting elements comprises one or more ovoids, conic-shaped cutting elements, wedge-shaped cutting elements, dual-chamfered cutting elements, bearing pads, or wear pads.

18. The removable blade assembly of claim 14, wherein the engagement portion is configured to deflect about the narrowed region responsive to experiencing a force on the engagement portion to the change of the exposure to the at least one other blade of the earth-boring tool.

19. A method of forming an earth-boring tool, comprising:

forming a body and a plurality of fixed blades extending from the body;

securing a first plurality of cutting elements to the plurality of fixed blades;

removably coupling at least one removable blade assembly to the body; and securing a second plurality of cutting elements to the at least one removable blade assembly, the at least one removable blade assembly exhibiting an aggressiveness that is different than an aggressiveness of the plurality of fixed blades and a blade portion of the at least one removable blade assembly is configured to deflect responsive to a Weight-on-Bit (WOB) and change exposure to at least one other blade of the earth-boring tool responsive to a change to the WOB.

20. The method of claim 19, wherein removably coupling at least one removable blade assembly to the body comprises:

inserting a leg of the at least one removable blade assembly into a slot of the body; and securing the at least one removable blade assembly via one or more fasteners.

* * * * *